US005184825A

United States Patent [19]

Ruth

[11] Patent Number: 5,184,825

[45] Date of Patent: Feb. 9, 1993

[54] GOLF CLUB PRACTICE APPARATUS

[76] Inventor: Terry W. Ruth, 13805 NW. 73rd St., Kansas City, Mo. 64195

[21] Appl. No.: 794,020

[22] Filed: Nov. 19, 1991

[51] Int. Cl.[5] ..... A63B 69/36

[52] U.S. Cl. ..... 273/186.2; 273/194 R; 273/DIG. 30

[58] Field of Search ..... 273/186 A, 194 R, 194 A, 273/194 B, 187.4, 186.2, DIG. 30

[56] References Cited

U.S. PATENT DOCUMENTS

| | | | |
|---|---|---|---|
| 3,565,444 | 2/1971 | LaRocca | 273/186 A |
| 3,719,363 | 3/1973 | Harrison | 273/186 A |
| 3,809,397 | 5/1974 | Gruenwald | 273/26 B |
| 4,576,378 | 3/1986 | Backus | 273/186 A |
| 4,588,191 | 5/1986 | Stewart | 273/194 B |

*Primary Examiner*—George J. Marlo

*Attorney, Agent, or Firm*—Hovey, Williams, Timmons & Collins

[57] ABSTRACT

A golf club practice apparatus is provided for use with a conventional golf club. The practice apparatus includes a sail having opposed front and rear surfaces, and attachment means along the central axis of the sail for attaching the sail to the golf club adjacent the club head with the front surface of the sail squared away with the impact surface of the club head. The attachment means included gripping means for gripping the golf club when the sail is attached to the golf club to prevent the sail from twisting on the shaft from the squared away position. When the apparatus is attached to the golf club, it raises the wind resistance of the golf club relative to the amount of wind resistance exhibited by the club during swinging movements made without the sail being attached, and this increased resistant is obtained without creating any torque forces on the club.

9 Claims, 1 Drawing Sheet

GOLF CLUB PRACTICE APPARATUS

BACKGROUND OF THE INVENTION

1. Field of the Invention

The present invention relates generally to practice devices for use by golfers and, more particularly, to a golf club practice apparatus that may be attached to a conventional golf club in order to permit a golfer to make practice swings with the golf club.

2. Discussion of the Prior Art

In the traditional stick and ball game of golf, it is desirable to accurately and consistently hit a ball toward an intended target and to get the ball to the target in the fewest number of shots possible. In order to obtain this goal many golfers seek to achieve the maximum distance possible with any given club in a standard set in order to reduce the number of shots necessary to reach the target.

An obvious means for achieving increased distance of any given golf shot is to increase the golfers ability to swing a golf club with the maximum possible club head velocity. It is known that club head velocity determines the distance a ball will travel along any given trajectory after being struck by the club.

In order to obtain increased club head velocity, a golfer must first develop the proper technique for swinging the golf club. However, in addition to using proper technique, it would also be desirable to increase the strength of the golfer, and more ideally the strength of the specific muscles used by the golfer during swinging, in order to increase the golfers ability to swing the club in such a way as to maximize the club head speed. In addition, it would also be beneficial to provide means not only for strengthening the muscles used by a golfer during swinging, but also for loosening these muscles during warm-up.

One known device for use during warm-up designed for loosening the muscles used by a golfer during swinging includes a donut-shaped weight that may be telescopically received on the golf club in order to temporarily increase the weight of the golf club to provide resistance to the golfer's efforts to swing the club. However, because this known device adds a substantial amount of weight to the club, the "feel" of the club changes substantially causing the golfer to work muscles differently than they would normally be worked during actual play.

More specifically, the gravitational force of the weight operates against the lifting movement of the club made during a back swing, causing the golfer to work the muscles used to make the back swing. However, during the forward swing of the golf club the gravitational force of the weight operates in the same direction as the swinging movement, such that the golfer actually uses the necessary muscles less than would normally be required when the weight is removed from the golf club. Because of this characteristic of the known weight device, the muscles used during swinging are actually worked in a manner differently then they would be worked under playing conditions.

OBJECTS AND SUMMARY OF THE INVENTION

It is an object of the present invention to provide a golf club practice apparatus that permits a golfer to loosen specific muscles used during swinging of a golf club and to actually increase the strength of those muscles in an effort to obtain the maximum possible club head velocity during swinging of a golf club.

It is another object of the invention to provide a practice apparatus which increases the weight of the golf club only slightly, while increasing the resistance of the golf club to swinging movement in order to require a greater effort by the golfer to swing the golf club, both during a back swing and a forward swing.

A further object of the invention is to provide a practice apparatus which may be easily attached to a golf club, or removed, and which can be stored conveniently on or within a golf bag or cart so that a golfer may use the apparatus repeatedly during play.

A golf club practice apparatus is provided for use with a golf club having a shaft and a club head connected to one end of the shaft. The apparatus includes a sail having opposed front and rear surfaces, and attachment means on the sail for attaching the sail to the golf club adjacent the club head with the front surface of the sail squared away with the impact surface of the club head. The attachment means includes gripping means for gripping the golf club when the sail is attached to the golf club to prevent the sail from twisting on the shaft from the squared away position, the apparatus raising the wind resistance of the golf club to swinging movements relative to the amount of wind resistance exhibited by the club during swinging movements made without the sail being attached.

By this construction numerous advantages are realized. For example, by constructing the apparatus of a lightweight material, the swing weight of a golf club is not substantially effected by attachment of the apparatus, but the resistance of the golf club to swinging is substantially increased. Thus, more effort is required from a golfer in order to move the golf club during both the back swing and the forward swing. Such increased effort works the specific muscles used in swinging a golf club and, with continued use, actually builds the strength of the specific muscles so that the golfer may generate greater club head speed during swinging.

In accordance with another aspect of the invention, a golf club practice apparatus includes a sail having a surface defining a central axis that divides the surface into side-by-side halves of substantially equal area. Attachment means are provided on the sail for attaching the sail to the golf club with one of the halves of the sail surface positioned adjacent the club head and with the central axis extending in a direction substantially parallel with the longitudinal axis of the shaft and being disposed within a plane which is parallel to a leading edge of the impact surface of the club head.

By providing a practice apparatus including these features, the resistance of the golf club to swinging movement is increased without adversely creating torsional or moment forces on the golf club which would change the "feel" of the golf club or force the golf club out of the normal path followed by the club during swinging.

BRIEF DESCRIPTION OF THE DRAWING FIGURES

A preferred embodiment of the invention is described in detail below with reference to the attached drawing figures, wherein.

DETAILED DESCRIPTION OF THE PREFERRED EMBODIMENT

Figure 1:
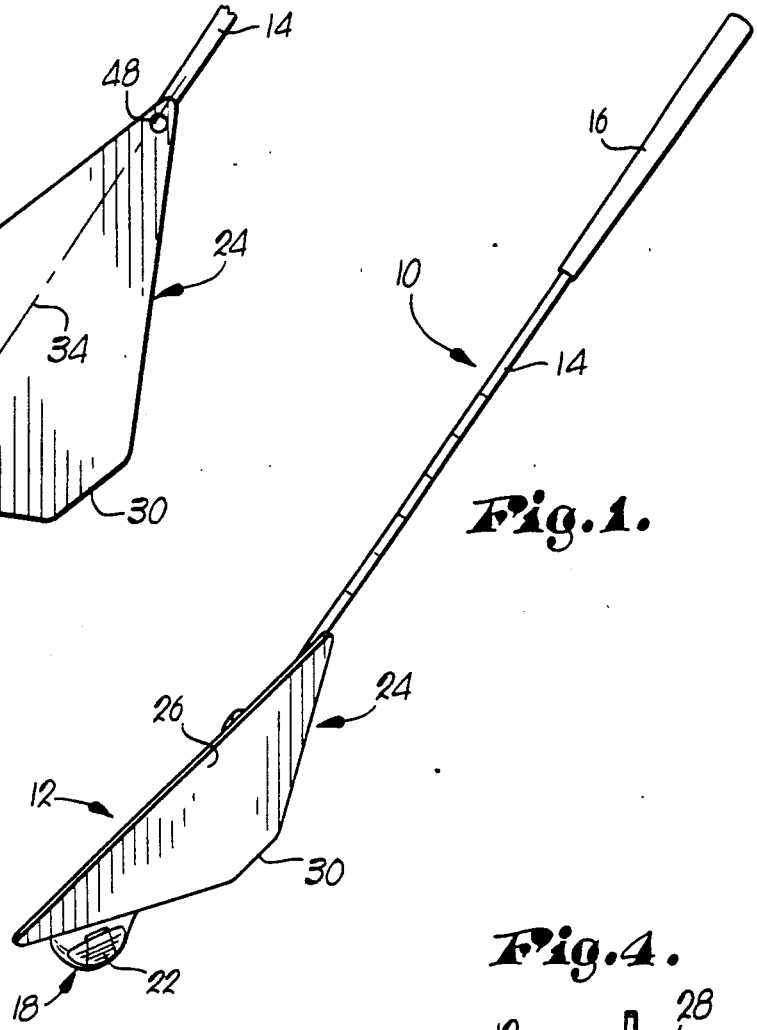
FIG. 1 is a perspective view of a golf club and a practice apparatus constructed in accordance with a preferred embodiment of the invention, illustrating the practice apparatus attached to the golf club.

A golf club 10 and practice apparatus 12 are illustrated in FIG. 1, with the practice apparatus shown in an attached position on the club.

Figure 2:
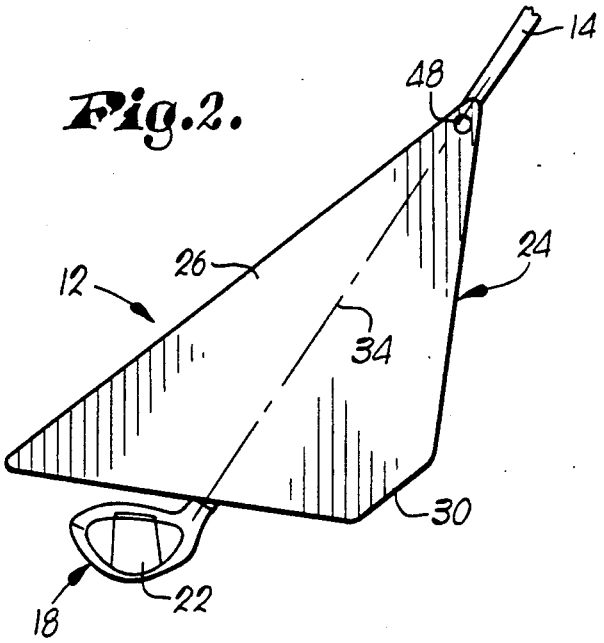
FIG. 2 is a front elevational view of the golf club and practice apparatus, and illustrating an optional hole in the apparatus useful for storage purposes.
Figure 3:
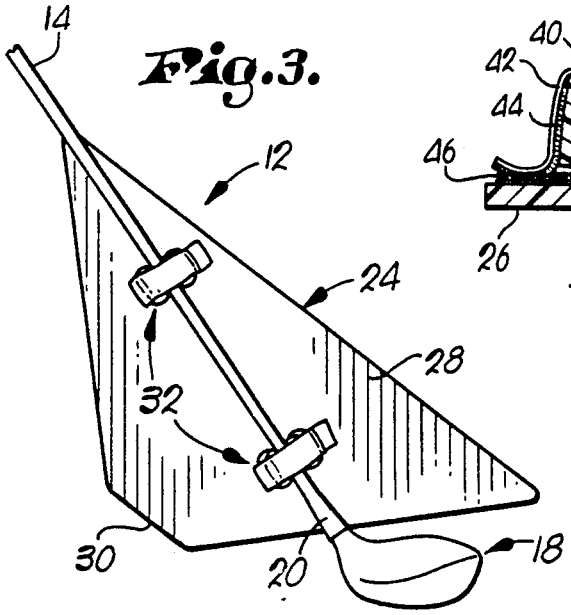
FIG. 3 is a rear elevational view of the golf club and practice apparatus.

The golf club 10 is of conventional construction, and includes an elongated, tapered shaft 14 defining a longitudinal axis and having a grip 16 provided at one axial end thereof and a club head 18 provided at the opposed, tapered end thereof. Turning to FIG. 3, the club head is illustrated as being connected to the shaft at a hosel 20. The club head includes a generally planer impact surface 22, as shown in FIG. 2, which extends outward from the shaft. The impact surface defines a leading edge that also extends outward from the shaft.

Although the golf club illustrated in the drawing figures is a driving club, it is noted that the practice apparatus of the invention may be used with equal effectiveness on any golf club that requires a swinging movement.

The practice apparatus 12 includes a sail 24 having opposed front and rear surfaces 26, 28, the front surface being illustrated in FIGS. 1 and 2, and the rear surface being shown in FIG. 3, and attachment means on the rear surface of the sail for attaching the sail to the golf club.

The sail 24 is preferably formed from sheet stock of a rigid, low density material in order to provide an apparatus that is lightweight yet of sufficient rigidity to deliver a measurable amount of resistance to swinging movements in order to benefit the golfer. According to one embodiment of the invention, high density polypropylene (HDPE) material is used to form the sail. This material has a density of 0.955–0.963 g/cm$^3$ and a heat deflection temperature at 264 psi of 110°–130° F.

The sail 24 may be formed by making a diagonal cut across a square sheet of the polypropylene material, resulting in a sail of triangular shape. Preferably, one corner 30 of the triangular sail is cut away in order to provide clearance of the sail relative to the ground during swinging of a golf club in order to prevent the sail from catching on the ground and being forced from attachment with the golf club. Also, the remaining two corners of the sail are rounded off, as are the edges, in order to remove any sharp points or edges that could cause injury.

In order to provide a sail presenting sufficient surface area to increase the resistance against swinging of the club to a desired level, the area of the front surface 26 of the sail should be between 25 and 200 square inches, and perferably between 60 and 80 square inches. In one preferred embodiment of the invention, a 12×12 inch square sheet of polypropylene may be cut diagonally to form two sails, each having an area of approximately 68 inches after trimming of the corners and edges.

By providing this amount of surface area the resistance of a golf club to swinging, when the sail is attached to the club, is increased by an amount sufficient to be sensed by a golfer of average strength and to cause the golfer to increase the effort used to swing the club. A sail with larger surface area should be used for stronger golfers, while smaller sail areas would be more appropriate for weaker golfers.

The thickness of the sail is designed to reduce the weight of the sail as much as possible while maintaining the rigidity of the sail. Although a slight amount of flexibility is desired, in order to permit the sail to flex with the shaft during swinging, excessive bending of the sail reduces the resistance effect provided.

The attachment means, as shown in FIG. 3, includes a pair of clips 32 fastened to the sail on the rear surface 28 and aligned with one another relative to a central axis 34 of the sail that divides the front surface into generally side-by-side halves of substantially equal area. By aligning the clips 32 in this fashion, when the sail 24 is attached to a golf club adjacent the club head 18 with the front surface 26 of the sail squared away with the impact surface 22 of the club head, the two halves generate a substantially equal amount of resistance in order to balance the moment forces acting on the sail during swinging.

By balancing these moment forces, the sail is prevented from twisting about the shaft 14, and torsional and moment forces acting on the golf club are reduced. Thus, swinging of the golf club, with the apparatus attached, feels very similar to swinging of the club without the apparatus. This "feel" results in the ability of the golfer to make a comfortable swinging motion during which the golf club and practice apparatus follow a path substantially identical to the path followed by the golf club during an actual golf swing made without the apparatus.

In order to accomplish the desired "feel", the sail 24 should be positioned on the shaft 14 as close to the club head 18 as possible, with one of the halves of the sail extending out over the club head and with the central axis 34 of the sail extending in a direction substantially parallel with the longitudinal axis of the shaft and being disposed within a plane which is parallel to the leading edge of the impact surface. This construction achieves the greatest increase in resistance to swinging for any given sail size.

Figure 5:
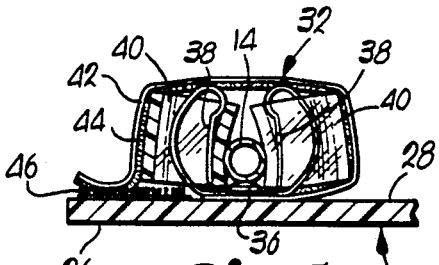
FIG. 5 is a fragmentary sectional view of the golf club and practice apparatus illustrating a clip of the apparatus.
Figure 4:
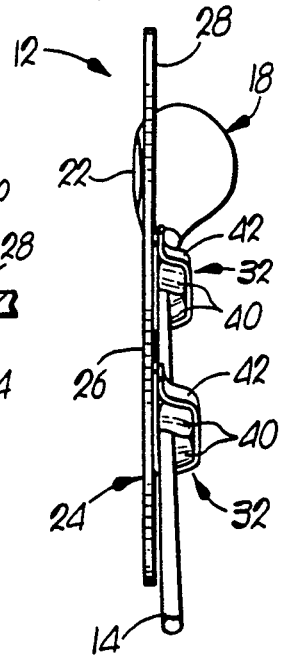
FIG. 4 is a top plan view of the golf club and practice apparatus.

Turning to FIG. 5, one of the clips 32 is shown as including a piece of formed spring metal fastened to the sail by a mechanical fastener 36, such as a screw or pop brad. The clip includes two, kidney-shaped halves, each provided with an inner leg 38 adapted to exert an inward holding force toward the opposing leg.

Gripping means are provided in the form of a pair of resilient sleeves 40 for gripping the golf club when the sail is attached to the golf club to prevent the sail from twisting on the shaft from the squared away position. The resilient sleeves 40 are formed of any suitable gripping material which, when interposed between the clips and the shaft, grips the clips and the shaft to hold the sail in position on the golf club. Preferably, conventional plastic tubing stock of a suitable diameter may be used to accomplish suitable gripping. The length of each sleeve is such that the clip halves may be manually manipulated in order to spread the inner legs from one another and allow attachment of the sail from the club.

Safety means are provided in association with each clip 32 for securing the shaft 14 of the golf club to sail 24 to prevent the sail from being released from the golf club during swinging movements of the club. In the event that the club head or sail strikes the ground during swinging, bending of the shaft may cause the shaft to detach from the clips. Such detachment would result in the sail flying free of the club. In order to protect against this nuisance, the safety means is provided.

Preferably, the safety means includes a strap 42 supported from the sail adjacent each clip 32, and means for permitting selective attachment of the straps across the clips. For example, each strap may be provided with loop material 44 on one surface thereof, and strip of hook material 46 may be secured to the rear surface of the sail, the hook and loop materials being cooperable to secure the straps across the clips. Thus, even if the shaft bends enough to pop from the clips, the sail is retained on the shaft by the straps which, together with the sail, surround the shaft.

As shown in FIG. 2, it is possible to provide a hole 48 in the sail through which a hook or other suitable support may be trained in order to permit storage of the practice apparatus, e.g. by hanging the apparatus from a golf bag or cart.

During swinging of a golf club with the practice apparatus attached, the impact surface of the club is presented to the ball square, i.e. within a plane that is not necessarily perpendicular to the direction along the ground in which travel of the ball is desired, but which includes an infinite number of horizontal lines extending in a direction perpendicular to the desired direction of travel. The sail is oriented in the same manner, with an infinite number of horizontal lines perpendicular to the desired direction of travel of the ball. By orienting the sail on the club in this manner, square with the impact surface, wind resistance of the club and apparatus is maximized for any given size of sail.

Thus, the practice apparatus permits a golfer to loosen specific muscles used during swinging of the club and to actually increase the strength of those muscles in an effort to obtain the maximum possible club head velocity during swinging of the club.

When the apparatus is used to work the muscles immediately prior to an actual golf swing, the short term memories of the muscles are trained to swing against the increased resistance, such that when the apparatus is removed, the muscles swing the club faster than they would without having first swung the club with the apparatus attached.

Although the invention has been described with reference to the preferred embodiment illustrated in the drawing figures, it is noted that substitutions may be made and equivalents employed herein without departing from the scope of the invention as recited in the claims.

For example, although the preferred embodiment illustrates a flat, triangular front surface, an angled surface, or a surface having a different shape could also be used so long as the resistance forces acting on the golf club, when the sail is attached, are balanced to prevent twisting of the club in the golfer's hand.

What is claimed is:

1. A golf club practice apparatus for use with a golf club having a shaft defining a longitudinal axis and a club head connected to one end of the shaft, the club head including an impact surface provided with a leading edge extending outward from the shaft, the apparatus comprising:

a sail having a surface defining a central axis that divides the surface into side-by-side halves of substantially equal area; and attachment means positioned along the central axis of the sail for attaching the sail to the golf club with one of the halves of the sail surface overlying the club head with the central axis of the sail extending in a direction substantially parallel with the longitudinal axis of the shaft, and with the surface of the sail disposed within a plane which is parallel to the leading edge of the impact surface, the attachment means including gripping means for gripping the golf club when the sail is attached to the golf club to prevent the sail from twisting on the shaft.

2. The practice apparatus as recited in claim 1, wherein the gripping means grips the shaft to prevent twisting of the sail.

3. The practice apparatus as recited in claim 1, wherein the sail is formed of polypropylene.

4. The practice apparatus as recited in claim 1, wherein the attachment means includes a pair of clips each sized for receiving the shaft of the golf club, the gripping means including a gripping material interposed between the clips and the shaft for gripping the clips and the shaft to hold the sail in position on the golf club.

5. The practice apparatus as recited in claim 4, further comprising safety means associated with each clip for securing the shaft of the golf club to the sail to prevent the sail from being released from the golf club during swinging movements of the club.

6. The practice apparatus as recited in claim 5, wherein the safety means includes a strap supported from the sail adjacent each clip, and means for permitting selective attachment of the straps across the clips.

7. The practice apparatus as recited in claim 1, wherein the sail surface has an area of between 25 and 200 square inches.

8. The practice apparatus as recited in claim 1, wherein the sail surface has an area of between 60 and 80 square inches.

9. The practice apparatus as recited in claim 1, wherein the sail surface is of generally triangular shape defining a lower edge and two inclined side edges, and includes a cut-out portion between the lower edge and the side edge remote from the club head.

* * * * *